US010525724B2

(12) United States Patent
Graham et al.

(10) Patent No.: US 10,525,724 B2
(45) Date of Patent: Jan. 7, 2020

(54) MIXER APPARATUS AND SYSTEM

(71) Applicant: The Technology Partnership Plc, Royston, Hertfordshire (GB)

(72) Inventors: Abi Graham, Cambridge (GB); Sam Pollock, Hitchin (GB); Neil Renault, Edinburgh (GB); Katie Sampson, Edinburgh (GB)

(73) Assignee: The Technology Partnership Plc (GB)

( * ) Notice: Subject to any disclaimer, the term of this patent is extended or adjusted under 35 U.S.C. 154(b) by 0 days.

(21) Appl. No.: 16/167,913

(22) Filed: Oct. 23, 2018

(65) Prior Publication Data

US 2019/0160828 A1 May 30, 2019

Related U.S. Application Data

(63) Continuation of application No. 15/526,470, filed as application No. PCT/GB2015/053390 on Nov. 9, 2015, now Pat. No. 10,137,698.

(30) Foreign Application Priority Data

Nov. 14, 2014 (GB) ..... 1420265.9

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01); *B41J 2/17513* (2013.01)

(58) Field of Classification Search
CPC ..... B41J 2/19; B41J 2/175; B41J 2/17513
See application file for complete search history.

(56) References Cited

U.S. PATENT DOCUMENTS

| | | | | |
|---|---|---|---|---|
| 3,929,071 | A | 12/1975 | Cialone et al. | |
| 4,383,263 | A | 5/1983 | Ozawa et al. | |
| 5,818,477 | A * | 10/1998 | Fullmer | B41J 2/01 347/43 |
| 2004/0066432 | A1 | 4/2004 | Hatada et al. | |
| 2015/0037445 | A1 | 2/2015 | Murphy et al. | |

FOREIGN PATENT DOCUMENTS

| | | | |
|---|---|---|---|
| EP | 0437363 | A2 | 7/1991 |
| WO | 9204986 | A2 | 4/1992 |
| WO | 9310910 | A1 | 6/1993 |
| WO | 02084119 | A1 | 10/2002 |
| WO | 2009049140 | A1 | 4/2009 |
| WO | 2013077187 | A1 | 5/2013 |

OTHER PUBLICATIONS

International Search Report for PCT/GB2015/053390 dated Jan. 22, 2016.

* cited by examiner

*Primary Examiner* — Bradley W Thies
(74) *Attorney, Agent, or Firm* — Lerner, David, Littenberg, Krumholz & Mentlik, LLP

(57) ABSTRACT

A mixer system for use with a non-contact liquid printer comprises: a printing liquid reservoir and an expansion volume; and an aspirator element, configured to reduce the pressure in the expansion volume, thereby to displace printing liquid from the reservoir to the expansion volume, and restore the pressure in the expansion volume, thereby to return the printing liquid to the reservoir so as to mix the printing liquid therein.

11 Claims, 7 Drawing Sheets

MIXER APPARATUS AND SYSTEM

CROSS-REFERENCE TO RELATED APPLICATIONS

The present application is a continuation of U.S. patent application Ser. No. 15/526,470, filed on May 12, 2017, which application is a national phase entry under 35 U.S.C. § 371 of International Application No. PCT/GB2015/053390 filed Nov. 9, 2015, published as WO 2016/075448, which claims priority from Great Britain Patent Application No. 1420265.9, filed Nov. 14, 2014, all of which are incorporated herein by reference.

The present invention relates to a mixer apparatus and system for a liquid. In a particular embodiment, the invention relates to a mixer apparatus and system for use with a non-contact liquid printer.

Diagnostic testing of biological samples can be performed efficiently using multiplexed assays whereby multiple reagents may be printed in an array on a test substrate and subsequently exposed to a test sample for analysis. If it were possible to print reagents containing cells (or other particles) then the range of tests that may be performed could be significantly extended.

Figure 1:
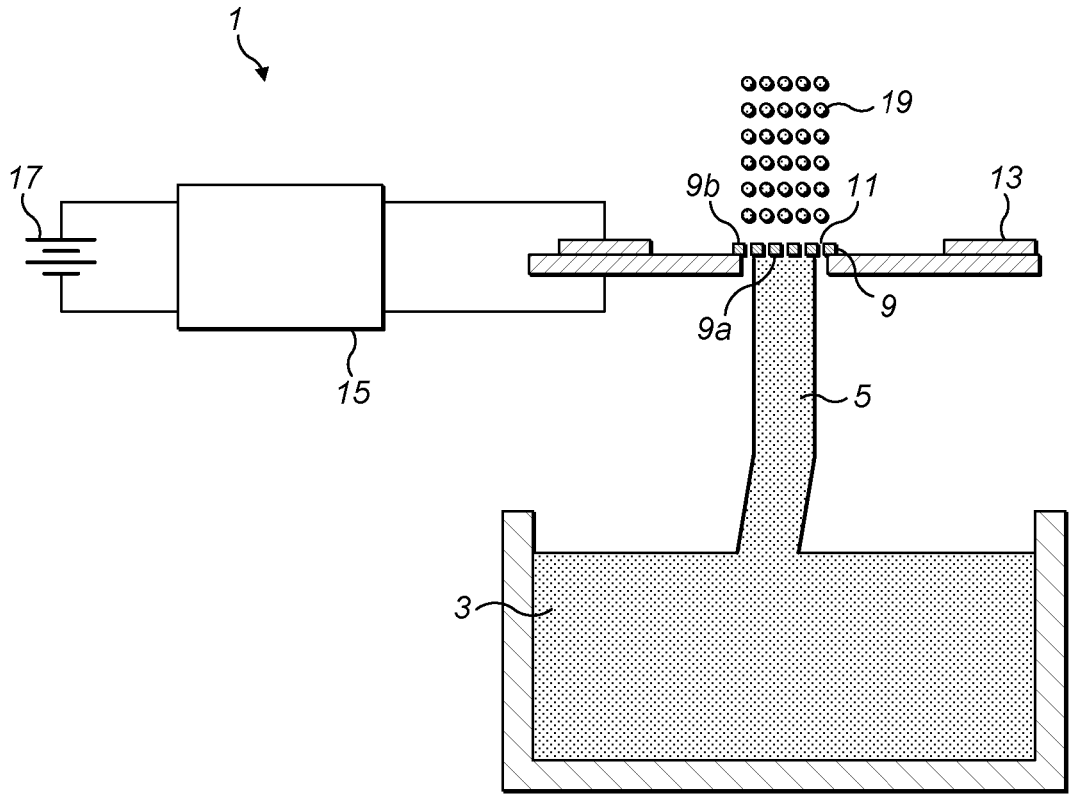

Referring to FIG. 1, a known non-contact printing apparatus 1, for example of the type described in WO-93/10910, comprises a fluid source 3 from which fluid is brought by capillary feed 5 to the rear face 9*a* of a perforate membrane 9 comprising a plurality of nozzles 11. A vibration means or actuator 13 is operable by an electronic circuit 15 which derives electrical power from a power supply 17 to vibrate the perforate membrane 9, producing droplets of fluid 19 from the front face 9*b* of the perforate membrane 9. The actuator 13 comprises a piezoelectric and/or electrostrictive actuator, or a piezomagnetic or magnetostrictive actuator in combination with an electrical or magnetic field applied within at least part of the actuator material alternating at a selected frequency. The actuator 13 may be formed as an element responsive by bending to an applied field. These forms of actuator can provide relatively large amplitudes of vibrational motion for a given size of actuator in response to a given applied alternating field. This relatively large motion may be transmitted through means bonding together regions of the actuator 13 and the perforate membrane 9 to provide correspondingly relatively large amplitudes of vibratory motion of the perforate membrane 9, so enhancing droplet dispensation.

Regarding the fluid source, it is typically the case that the cells (or other particles) will not be neutrally buoyant and so will sediment over time with resulting changes in homogeneity. If this is not addressed in a printing application it may result in a variation in cell concentration over time, which could cause an adverse impact on either the print performance or the reagent quality.

An additional challenge with cells (and other types of biological material) is that they often have a tendency to adhere to each other, often forming 'clumps'. Also, cells are relatively delicate and prone to damage when exposed to mechanical shear (e.g. in pumping) and fluid volumes are very small; consequently external recirculation circuits are typically not possible. Interventions within the liquid reservoir to mix the cells may result in pressure disturbances which, in turn, could have an adverse impact on printing behaviour. The introduction of gas bubbles within the liquid has the potential to compromise printing behaviour and therefore mixing methods that include this risk are to be avoided.

Current approaches to re-suspend cells typically involve re-circulation circuits, including a pump of some kind to create a flow within the reservoir and thereby induce mixing. Alternate approaches may include a rotating stirrer within the reservoir. Both of these approaches require a relatively large volume of liquid and are therefore not amenable to systems working with low liquid volumes. Additionally, these agitation methods induce shear within the liquid which can be problematic for some cell types, causing unwanted cell damage.

Accordingly, it would be beneficial to provide stable cell concentration in the region of the printer nozzle, over time, without degradation of cells.

The invention is set out in the accompanying claims.

According to an aspect of the invention, there is provided a mixer system for use with a non-contact liquid printer, comprising: a printing liquid reservoir and an expansion volume; and an aspirator element, configured to reduce the pressure in the expansion volume, thereby to displace printing liquid from the reservoir to the expansion volume, and restore the pressure in the expansion volume, thereby to return the printing liquid to the reservoir so as to mix the printing liquid therein.

Appropriate printing liquids include, but are not limited to, reagents which may include DNA, proteins, antibodies, cells and cell fragments, other biological materials or particles, and other materials including suspensions. Liquid mixing is achieved through aspiration and subsequent dispense of a volume of liquid in the printing liquid reservoir, providing mixing of the liquid which prevents sedimentation without causing damage to the cells (or other particles) therein. "Mixing" and "mixer" as used herein refer to a disturbing or agitating action, which tends to separate cells (or other particles) which have adhered or 'clumped' together, and/or tends to cause re-suspension of cells (or other particles) in the liquid. The frequency of mixing may be substantially more frequent than the sedimentation time of cells in the liquid, but not so frequent as to "over-handle" (and possibly lyse) the cells. A range of about two to three minutes has been found to be appropriate.

The aspirator element may be configured to be moved from a first position or condition, in order to reduce the pressure in the expansion chamber, and returned to the first position or condition, in order to restore the pressure in the expansion chamber. The aspirator element may be configured for periodic movement from and to the first position or condition. The aspirator element may be arranged to be co-ordinated (optionally synchronised) with printing operations of the non-contact liquid printer. The movement of the aspirator element may be arranged to provide mixing of the printing liquid while the printer is not printing. Co-ordination with printing can beneficially avoid the effects of any transient pressure events.

The aspirator element may comprise a piston, arranged to reciprocate in a bore. The expansion chamber may include the bore, in which case the bore may have an internal diameter of about 1.5 millimetres. Alternatively, the bore may be separate from the expansion chamber. The mixer system may comprise a resilient element, for example a spring, configured to move the piston from or to the first position or condition. Alternatively, the aspirator element may comprise an inflatable element, for example an inflatable bag, or a bellows, or a diaphragm. Alternatively, the aspirator element may comprise a pump, for example a vacuum pump.

The printing liquid may have a volume of about 0.5 to 1.0 millilitres, optionally about 1.0 millilitre. The printing liquid may be displaced at a flow rate of about 0.1 to 1.0 millilitres per second. The printing liquid may comprise a particulate suspension. The printing liquid may comprise a biological material, for example a biological material including cells in suspension. Flow rates and geometries can be carefully arranged to minimise both cell stress and pressure disturbances. Control of the system can be managed to avoid the introduction of gas bubbles.

According to another aspect of the invention, there is provided a non-contact liquid printer, comprising a mixer system as described herein above.

According to another aspect of the invention, there is provided mixer apparatus for use with a printing liquid reservoir of a non-contact liquid printer, the mixer apparatus comprising: an expansion chamber, connectable to the reservoir; an aspirator element, configured to reduce the pressure in the expansion chamber, thereby to displace printing liquid from the reservoir to the expansion chamber, and to restore the pressure in the expansion chamber, thereby to return the printing liquid to the reservoir so as to mix the printing liquid therein.

According to another aspect of the invention, there is provided a non-contact liquid printer, comprising mixer apparatus as described herein above.

According to another aspect of the invention, there is provided a method of mixing a liquid for use in a non-contact liquid printer, the printer comprising a printing liquid reservoir and an expansion volume, the method comprising: operating an aspirator element in order to reduce the pressure in the expansion volume, thereby to displace printing liquid from the reservoir to the expansion volume; and operating the aspirator element in order to restore the pressure in the expansion volume, thereby to return the printing liquid to the reservoir so as to mix the printing liquid therein.

According to another aspect of the invention, there is provided mixer apparatus for a liquid, comprising: a liquid reservoir and an expansion volume; and an aspirator element, configured to reduce the pressure in the expansion volume, thereby to displace liquid from the reservoir to the expansion volume, and to restore the pressure in the expansion volume, thereby to return the liquid to the reservoir so as to mix the liquid therein.

As has been described herein above, the aspirator element may comprise a piston, an inflatable element, or a pump. It will be apparent to the skilled reader that the aspirator element could take various other forms which achieve the same effect—of providing a reduction in gas pressure in order to displace the liquid—and all of these are within the scope of the claimed invention.

Figure 2A:
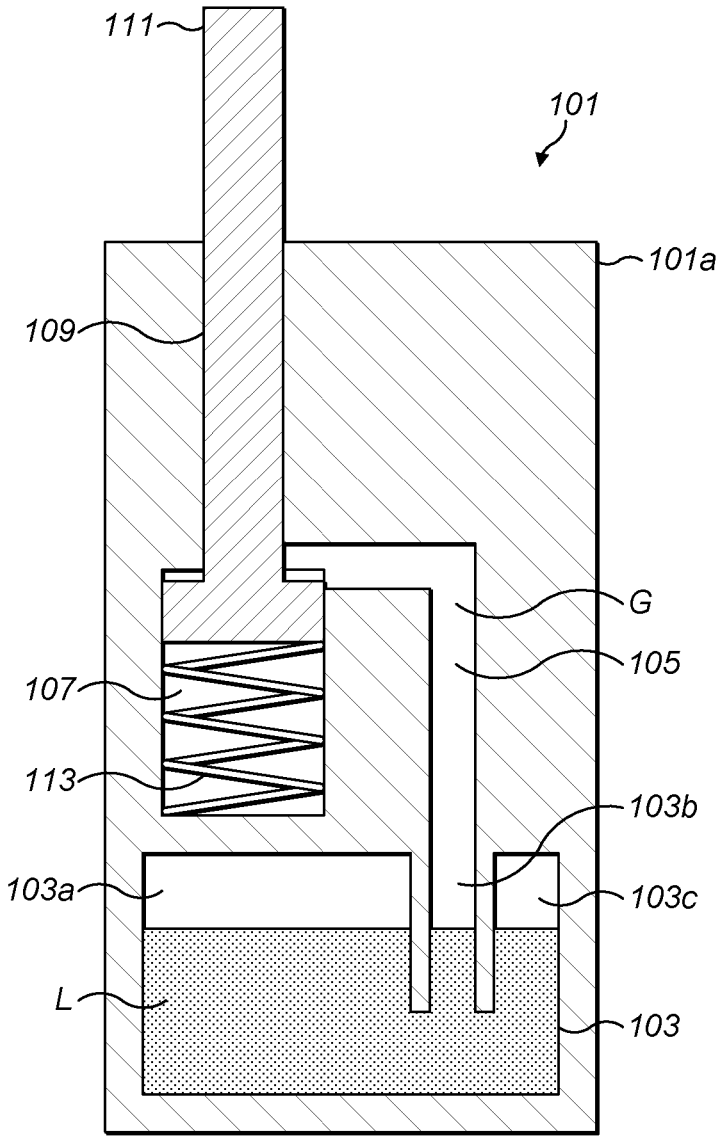
Figure 2B:
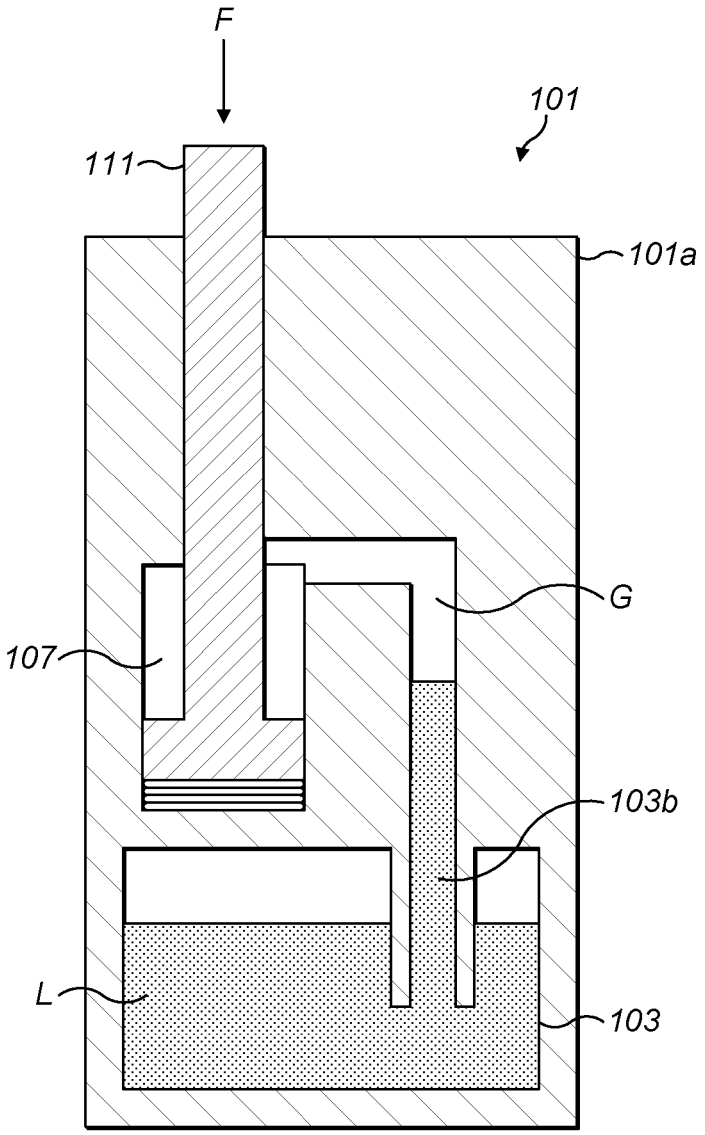

Embodiments will now be described, by way of example, with reference to the accompanying figures in which:

FIG. 1 is a schematic depiction of a known non-contact printing apparatus;

FIGS. 2*a* and 2*b* show simplified, cross-sectional views of an embodiment of a mixer system in accordance with the invention; and FIGS. 3*a* to 4*b* show alternative embodiments of the mixer system.

Referring to FIG. 2*a*, a housing 101*a* of a mixer system 101 for a non-contact printer (not shown) comprises a reservoir 103 containing a liquid L, in this embodiment a reagent including biological cells. An upper portion of the reservoir 103 comprises three sections 103*a-c*, a central section 103*b* extending from the reservoir 103, through the housing 101*a*, to form an expansion chamber 105 which is in fluid connection with a cavity 107 also in the housing 101*a*. The expansion chamber 105 and cavity 107 contain a gas G, for example air. A passageway 109 extends from the cavity 107 to an opening at an edge of the housing 101*a*.

In this embodiment, a plunger or piston 111 has a head portion which is disposed in the cavity 107 and a body portion which extends through the passageway 109 and projects out of the opening at the edge of the housing 101*a*. The passageway 109 and cavity 107 together comprise a bore in which the piston 111 may slide. The body portion of the piston 111 provides a substantially gas-tight seal with the passageway 109, such that the gas G cannot escape from the housing 101*a* and ambient air cannot enter the housing 101*a*.

A resilient element, in this embodiment a spring 113, is provided in the cavity 107 and arranged to exert a force on the head portion of the piston 111 in order to bias the head portion of the piston 111 in a first position at one end of the cavity 107. With the piston 111 in this first position, the level of the liquid L is the same at all three sections 103*a-c* of the reservoir 103.

The operation of the mixer apparatus 101 will now be described. Referring to FIG. 2*b*, a pushing force F is applied to the body portion of the piston 111 in order to overcome the resistance of the spring 113 and move the piston 111 along the bore until the head portion of the piston 111 reaches the limit of its travel at the other end of the cavity 107. The movement of the piston 111 causes a progressive increase in the volume, and fall in gas pressure, of the expansion chamber 105. Consequently, the pressure acting on the surface of the liquid L, at section 103*b* of the reservoir 103, is reduced. Accordingly, the pressure head of the liquid L causes the level of the liquid L to rise in the central section 103*b*, until a pressure equilibrium condition is achieved and the level settles. Thus, the liquid L is aspirated as the pressure in the expansion chamber 105 is reduced, by, in this embodiment, the reciprocating motion of the piston 111.

The pushing force F is then removed, in a controlled manner, so that the piston 111 travels back along the bore under the biasing force exerted by the spring 113, until the piston 111 has returned to its original position as shown in FIG. 2*a*. As the piston 111 moves, the volume of the expansion chamber 105 is progressively reduced, and the gas pressure increased, so that the liquid L falls back to its original level.

In an embodiment, the cavity 107 is omitted and the piston 111 is arranged to reciprocate in the expansion chamber 105.

In an embodiment, the resilient element is arranged to bias the piston 111 in the opposite direction to that described hereinabove. Accordingly, a pulling force F may be applied to the body portion of the piston 111 against the resistance of the resilient element.

Figure 3A:
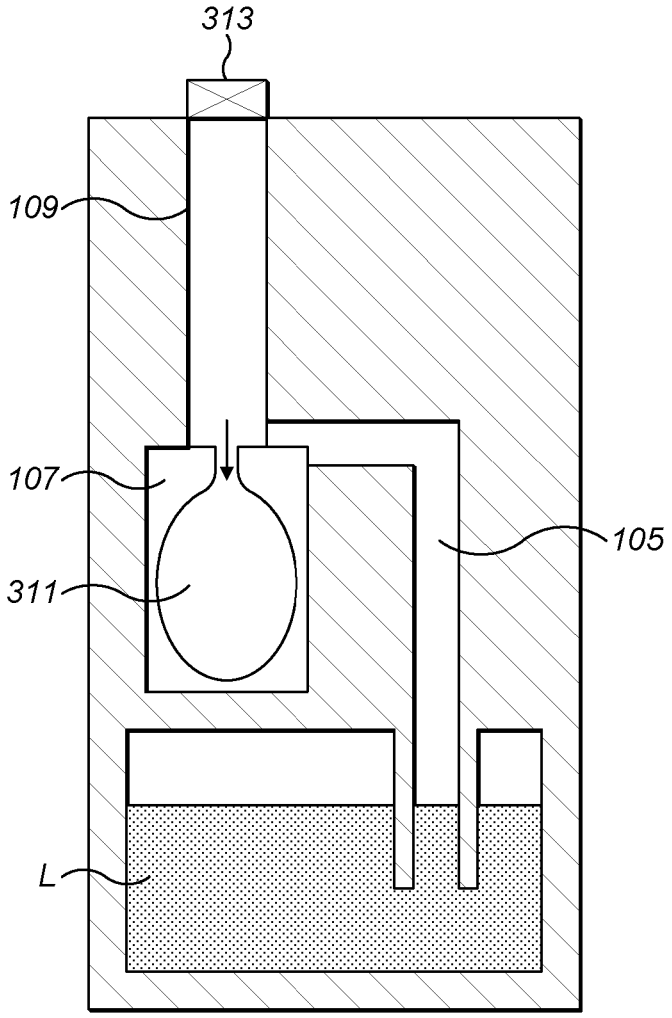
Figure 3B:
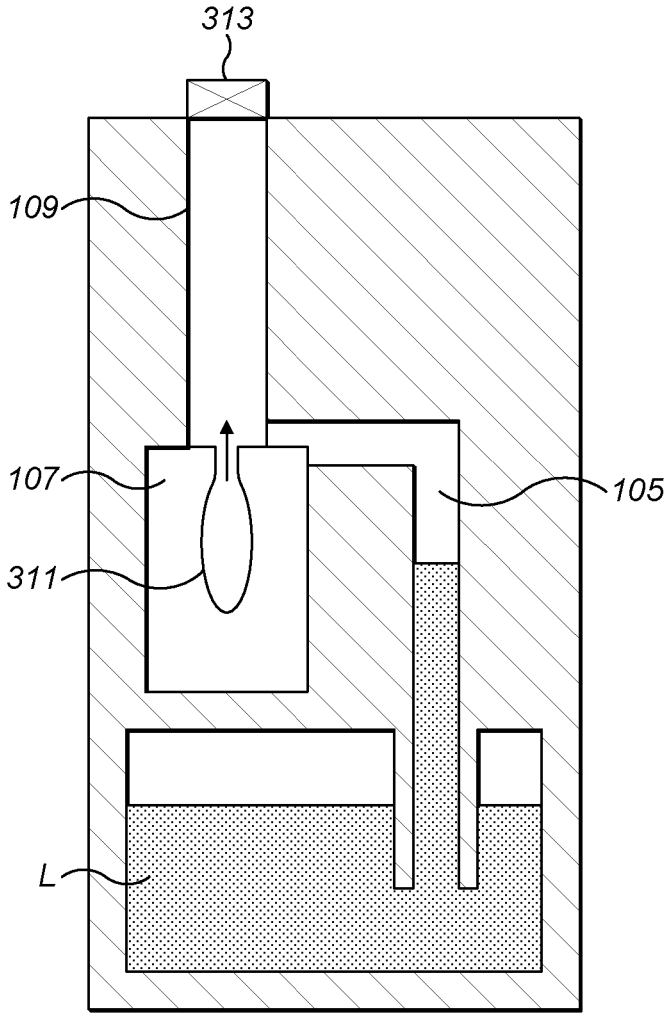

In an alternative embodiment, shown in FIGS. 3*a* and 3*b*, the piston is omitted and instead the cavity 107 (or, alternatively, the expansion chamber 105) contains an inflatable element, in this embodiment an inflatable bag 311 (or, alternatively, a bellows or a diaphragm) in fluid communication with a valve 313 and an ambient air supply. In the condition shown in FIG. 3*a*, the bag 311 has been filled with pressurised ambient air and the valve 313 has been closed, so that the level of the liquid L is the same at all three sections 103*a-c* of the reservoir 103. Referring to FIG. 3*b*, opening the valve 313 causes the bag 311 to deflate as the air escapes, leading to a progressive increase in the volume, and fall in gas pressure, of the expansion chamber 105. Consequently, the pressure acting on the surface of the liquid L, at section 103*b* of the reservoir 103, is reduced. Accordingly, the pressure head of the liquid L causes the level of the liquid L to rise in the central section 103*b*, until a pressure equilibrium condition is achieved and the level settles. Thus, the liquid L is aspirated as the pressure in the expansion chamber 105 is reduced, by, in this embodiment, the deflation of the bag 311.

The bag 311 is then re-inflated and the valve 313 closed, in a controlled manner, so that the volume of the expansion chamber 105 is progressively reduced, and the gas pressure increased, so that the liquid L falls back to its original level.

Figure 4A:
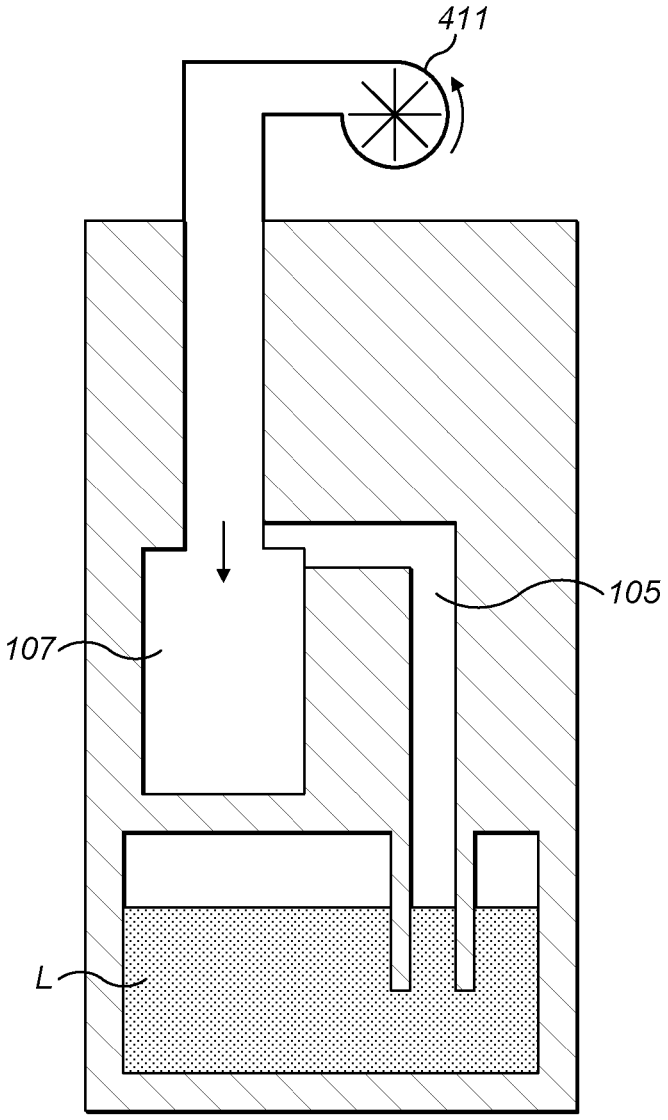
Figure 4B:
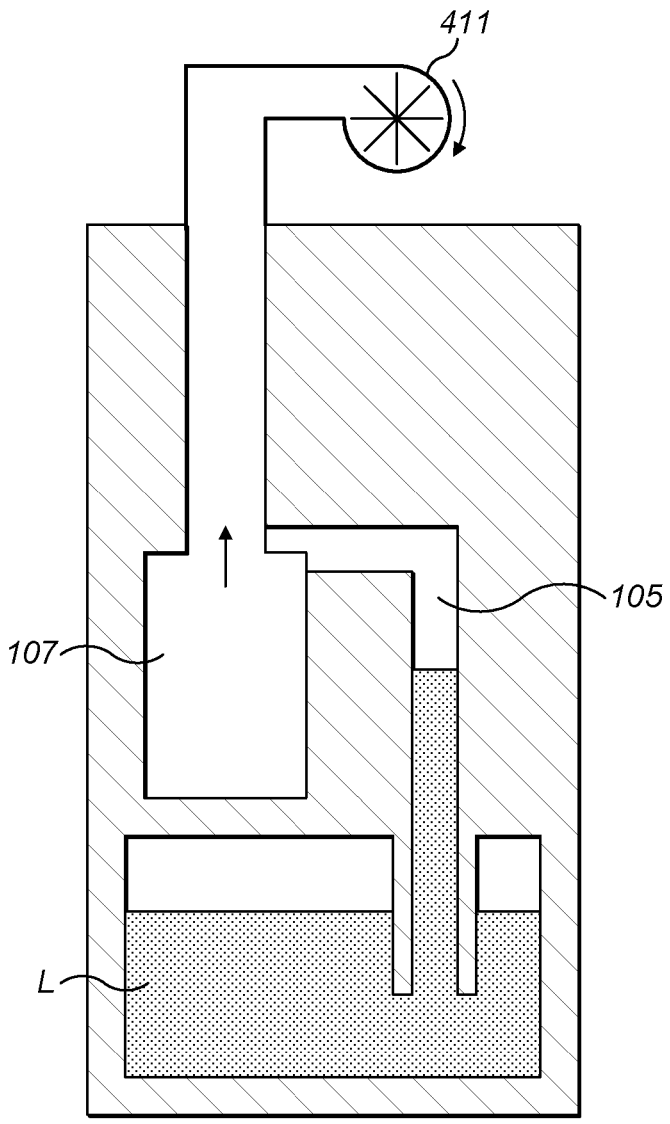

In another alternative embodiment, shown in FIGS. 4*a* and 4*b*, the aspirator element instead comprises a pump 411, arranged in fluid communication with the cavity 107. In the condition shown in FIG. 4*a*, ambient air has been pumped into the cavity 107 (or, alternatively, the expansion chamber 105) and the level of the liquid L is the same at all three sections 103*a-c* of the reservoir 103. Referring to FIG. 4*b*, the pump is operated to suck the air from the cavity 107, leading to a progressive fall in gas pressure in the expansion chamber 105. Consequently, the pressure acting on the surface of the liquid L, at section 103*b* of the reservoir 103, is reduced. Accordingly, the pressure head of the liquid L causes the level of the liquid L to rise in the central section 103*b* of the reservoir 103, until a pressure equilibrium condition is achieved and the level settles. Thus, the liquid L is aspirated as the pressure in the expansion chamber 105 is reduced, by, in this embodiment, the vacuum effect of the pump 411.

The pump is then activated to re-pressurise the cavit 107, in a controlled manner, so that the gas pressure of the expansion chamber 105 is progressively increased and the liquid L falls back to its original level.

In each of the above-described exemplary embodiments, a flow induced in the liquid L by the aspiration action causes mild disturbance or agitation and thereby mixing of the liquid L in the reservoir 103, such that clumped cells are separated from one another, and/or heavier particles are disturbed and sedimentation at the bottom of the reservoir 103 is prevented, or at least reduced, without damaging the cells. Accordingly, the printer nozzle may be supplied, over time, with a stable cell concentration without degradation of cells.

In each of the above-described exemplary embodiments, the liquid L may have a volume of about 0.5 to 1.0 millilitre, but the invention is also applicable to significantly larger (or smaller) volumes of liquid.

It will be understood that the invention has been described in relation to its preferred embodiments and may be modified in many different ways without departing from the scope of the invention as defined by the accompanying claims.

Furthermore, while the invention is particularly well-suited to printing, it will be understood that the invention has wide utility for mixing liquids in a variety of technical fields.

The invention claimed is:

1. A non-contact printing system comprising:

a printing liquid reservoir configured to contain a printing liquid defining a first printing liquid surface;

an expansion chamber in fluid communication with the printing liquid, the expansion chamber including a bore; and an aspirator element in fluid communication with the expansion chamber, the aspirator element including a piston arranged to reciprocate in the bore, wherein the piston is movable from a first position to a second position to reduce a pressure of a gas in the expansion chamber such that a pressure head of the printing liquid moves the printing liquid from the printing liquid reservoir to the expansion chamber to cause a second printing liquid surface defined by the expansion chamber to rise in the expansion chamber from a first level to a second level, wherein the piston is movable from the second position to the first position to restore the pressure of the gas in the expansion chamber such that the pressure head of the printing liquid moves the printing liquid from the expansion chamber to the printing liquid reservoir returning the second printing liquid surface from the second level to the first level, so as to cause mixing of the printing liquid in the printing liquid reservoir, wherein the pressure head of the printing liquid is defined as a pressure differential between a first pressure acting on the first printing liquid surface and a second pressure acting on the second printing liquid surface.

2. A non-contact printing system according to claim 1, further comprising:

a housing containing the printing liquid reservoir and a cavity; and a passageway connecting the cavity to an opening of the housing such that the passageway and the cavity together comprise the bore, wherein the piston forms a gas tight seal with the opening of the housing, wherein movement of the piston from the first position to the second position opens the expansion chamber to the cavity to reduce the pressure of the gas in the expansion chamber, and movement of the piston from the second position to the first position closes the expansion chamber to the cavity to restore the pressure of the gas in the expansion chamber.

3. A non-contact printing system of claim 1, wherein the printing liquid rises in the expansion chamber at a rate between 0.1 to 1.0 milliliters per second.

4. A non-contact printing system of claim 1, wherein the printing liquid has a volume of about 0.5 to 1.0 milliliters.

5. A non-contact printing system comprising:

a printing liquid reservoir, configured to contain a printing liquid defining a first printing liquid surface;

an expansion chamber in fluid communication with the printing liquid, the expansion chamber including a bore; and an aspirator element in fluid communication with the expansion chamber, the aspiration element including an inflatable element which is located in the expansion chamber and configured to be selectively inflated and deflated by an air supply of the non-contacting printing system, wherein the inflatable element is adjustable from an inflated condition to a deflated condition to increase the volume of the expansion chamber and reduce the pressure of the gas in the expansion chamber such that a pressure head of the printing liquid moves the printing liquid from the printing liquid reservoir to the expansion chamber to cause a second printing liquid surface defined by the expansion chamber to rise in the expansion chamber from a first level to a second level, wherein the inflatable element is adjustable from the deflated condition to the inflated condition to reduce the volume of the expansion chamber and restore the pressure of the gas in the expansion chamber such that the pressure head of the printing liquid moves the printing liquid from the expansion chamber to the printing liquid reservoir returning the second printing liquid surface from the second level to the first level to cause mixing of the printing liquid in the printing liquid reservoir, wherein the pressure head of the printing liquid is defined as a pressure differential between a first pressure acting on the first printing liquid surface and a second pressure acting on the second printing liquid surface.

6. A non-contact printing system comprising according to claim 5, further comprising:

a housing, containing the printing liquid reservoir and cavity connected to the expansion chamber;

a passageway connecting the cavity to an opening of the housing; and a valve connected to the opening of the housing and to an air supply of the non-contact printing system, wherein the valve is operable to adjust the inflatable element from the inflated condition to the deflated condition to increase the volume of the cavity and reduce the pressure of the gas in the expansion chamber, and the valve is further operable to adjust the inflatable element from the deflated condition to the inflated condition to reduce the volume of the cavity and restore the pressure of the gas in the expansion chamber.

7. A non-contact printing system according to claim 6, wherein the inflatable element comprises any of an inflatable bag, a bellows, or a diaphragm.

8. A non-contact printing system according to claim 5, wherein the inflatable element comprises any of an inflatable bag, a bellows and a diaphragm.

9. A non-contact printing system for printing multiple reagents in an array on a test substrate comprising a first mixer system and a second mixer system, wherein each of the first and second mixer systems comprising:

a printing liquid reservoir, configured to contain a printing liquid defining a first printing liquid surface;

an expansion chamber in fluid communication with the printing liquid, the expansion chamber including a bore; and an aspirator element in fluid communication with the expansion chamber, the aspirator element including a piston arranged to reciprocate in the bore, wherein the piston is movable from a first position to a second position to reduce a pressure of a gas in the expansion chamber such that a pressure head of the printing liquid moves the printing liquid from the printing liquid reservoir to the expansion chamber to cause a second printing liquid surface defined by the expansion chamber to rise in the expansion chamber from a first level to a second level, wherein the piston is movable from the second position to the first position to restore the pressure of the gas in the expansion chamber such that the pressure head of the printing liquid moves the printing liquid from the expansion chamber to the printing liquid reservoir returning the second printing liquid surface from the second level to the first level, so as to cause mixing of the printing liquid in the printing liquid reservoir, wherein the pressure head of the printing liquid is defined as a pressure differential between a first pressure acting on the first printing liquid surface and a second pressure acting on the second printing liquid surface, wherein the first mixer system includes a first printing liquid and the second mixer system includes a second printing liquid.

10. The non-contact printing system of claim 9, wherein the first printing liquid includes a first biological material and the second printing liquid includes a second biological material.

11. The non-contact printing system of claim 10, wherein any of the first and second biological materials include cells in suspension.

* * * * *